US006315169B1

(12) United States Patent
de Rosa

(10) Patent No.: US 6,315,169 B1
(45) Date of Patent: Nov. 13, 2001

(54) FLUID PRODUCT DISPENSER WITH SNAP-ON FIXING RING

(75) Inventor: Daniel de Rosa, Louviers (FR)

(73) Assignee: Valois S.A., Le Neubourg (FR)

( * ) Notice: Subject to any disclaimer, the term of this patent is extended or adjusted under 35 U.S.C. 154(b) by 0 days.

(21) Appl. No.: 09/445,666

(22) PCT Filed: Jun. 10, 1998

(86) PCT No.: PCT/FR98/01195

§ 371 Date: Apr. 19, 2000

§ 102(e) Date: Apr. 19, 2000

(87) PCT Pub. No.: WO98/56688

PCT Pub. Date: Dec. 17, 1998

(30) Foreign Application Priority Data

Jun. 13, 1997 (FR) ..... 97 07317

(51) Int. Cl.[7] ..... B35D 45/30

(52) U.S. Cl. ..... 222/321.7; 222/321.9; 222/570; 215/272; 215/274

(58) Field of Search ..... 215/272, 274; 222/321.7, 321.9, 570

(56) References Cited

U.S. PATENT DOCUMENTS 4,773,553 * 9/1988 Van Brocklin ..... 215/272
5,299,703 4/1994 Cater .
5,562,219 * 10/1996 de Pous et al. ..... 222/321.9

FOREIGN PATENT DOCUMENTS 0 006 032 12/1979 (EP) .
2 769 860 A1 4/1999 (FR) .
2 274 836 8/1994 (GB) .

* cited by examiner

*Primary Examiner*—Philippe Derakshani
(74) *Attorney, Agent, or Firm*—Rockey, Milnamow & Katz, Ltd.

(57) ABSTRACT

The invention concerns a fixing device for a fluid product dispenser adapted for mounting on a container or reservoir which has a neck. A dispensing member is mounted on the reservoir neck. The neck has an outer peripheral thickness defining, with the rest of the neck, a lower shoulder. The fixing device comprises a fixing ring to fix the dispensing member on the neck. The fixing ring comprises a peripheral skirt extending up to beneath the shoulder. The skirt is provided with flaps, the ends of which point inwards and upwards and are urged to stop in contact against the shoulder thereby providing a catching mechanism for the fixing ring on the reservoir neck.

26 Claims, 1 Drawing Sheet

FLUID PRODUCT DISPENSER WITH SNAP-ON FIXING RING

TECHNICAL FIELD

The present invention relates to a dispenser for dispensing a fluid substance, the dispenser comprising a container having a neck, and a dispenser member, such as a pump or a valve, mounted on the neck so as to extract the fluid. The invention relates more particularly to a fixing ring for fixing said dispenser member to a neck provided with an outwardly-projecting peripheral thick portion which co-operates with the remainder of the neck to form a bottom shoulder. That type of container with such a neck is in widespread use for pumps or valves that are snap-fastened onto the neck by using the bottom shoulder as a retaining or abutment surface.

BACKGROUND OF THE INVENTION

Document FR-0 704 251 discloses a fixing ring provided with snap-fastening catches at the ends of which snap-fastening lugs designed to be received under the shoulder on the neck are formed. A band then covers the ring to prevent the lugs from being released from under the shoulder. With that type of fixing device, it is possible to remove the ring from the neck so long as the band is not mounted. The snap-fastening catches are flexible, which makes it possible for the lugs to pass over the thick portion to reach the snap-fastening position under the shoulder. Therefore, on mounting the ring on such a neck, the catches must bend outwards, which increases the working diameter of the ring as it passes over the thick portion of the neck. In addition, the ring is permanently fixed only once the band has been mounted: the fixing thus requires two parts.

Document U.S. Pat. No. 4,773,553 discloses another fixing device in which the fixing ring is made of a plastically-deformable material and is provided with catches having heads initially projecting outwards. It is thus possible to mount the ring on the neck without deforming the catches outwards. Final fixing is achieved by engaging a band by force over the ring so that the outwardlyprojecting catches are brought back inwards under the shoulder on the neck by the material being deformed plastically. In which case, two parts are also necessary to perform the fixing, and, in addition, some force must be exerted on the band to cause the heads to deform inwards.

Document U.S. Pat. No. 5,299,703 describes a pump-fixing system in which a ring is provided with catches terminated by heads formed inwardly-projected bulges. Prior to being mounted the bulging heads are bent outwards to enable the neck to pass between them. Once in position on the neck of the container, the heads are deformed inwards by means of a band. That system is analogous to the system of Document U.S. Pat. No. 4,773,553, except that the ring is made of metal, and that the heads are bent inwards rather than being caused to deform plastically. Since the ring is made of metal, that system can be likened to crimping because the metal is deformed so as to reduce the inside diameter of the ring. It is also necessary to use a tool to fix the ring to the neck of the container.

SUMMARY OF THE INVENTION

An object of the present invention is to remedy the drawbacks of the above-mentioned prior art by providing a fixing device whose fixing ring achieves permanent fixing without requiring a separate band, and in which mounting the ring involves no deformation of the ring relative to its normal rest dimensions.

To this end, the present invention provides a fixing device for a dispenser for dispensing a fluid substance, the dispenser being suitable for being fitted to a container provided with a neck, and comprising a dispenser member mounted on the neck of the container, said neck forming an outwardly-extending peripheral thick portion co-operating with the remainder of the neck to form a bottom shoulder, said fixing device comprising a fixing ring for fixing the dispenser member to the neck, the fixing ring being provided with a peripheral skirt which extends to below said shoulder, said skirt being provided with flaps whose free ends point inwards and upwards and come into abutment contact against the shoulder, thereby snap-fastening the fixing ring to the neck of the container. On passing over the thick portion, the flaps are situated within the skirt without projecting outwards beyond it, and they can then be bent or can then take up their snap-fastening angular position under the shoulder. Advantageously, the flaps are prestressed to point inwards during manufacture of the fixing ring. In which case, the flaps return automatically to their original prestressed angular positions in which they point inwards as soon as they go past the thick portion. In a variant, the flaps are urged inwards once the ring is in position on the neck. In which case, a subsequent operation is necessary in order to bend the flaps under the shoulder. In both cases, the fixing is achieved by the ring on its own, without requiring an additional band. The flap ends that are in abutment against the shoulder guarantee permanent fixing on their own.

Preferably, the thickness of the wall of each of the flaps is equal to or less than the thickness of the wall of the skirt so that they do not project from the skirt as the flaps pass over the peripheral thick portion of the neck. It is thus possible to pre-mount the fixing ring inside a decorative trim band, and then to mount the resulting assembly on the container neck. Whereas, in the prior art, the snap-fastening catches must be deformed outwards to pass over the thick portion, in the present invention, the flaps are never deformed outwards, which makes it possible to pre-mount a band that is purely decorative since it is not necessary for fixing the ring to the neck.

The present invention also provides a dispenser including such a fixing device for fixing the dispenser member to the neck of the container.

The invention is described more fully below with reference to the sole figure which, by way of nonlimiting example, shows a cross-section through an embodiment of a dispenser of the invention.

The sole figure shows only the top portion of the dispenser which, all together, comprises a container 1, a fixing device 20, and a dispenser member 2.

DETAILED DESCRIPTION OF THE PREFERRED EMBODIMENT

Figure 1:
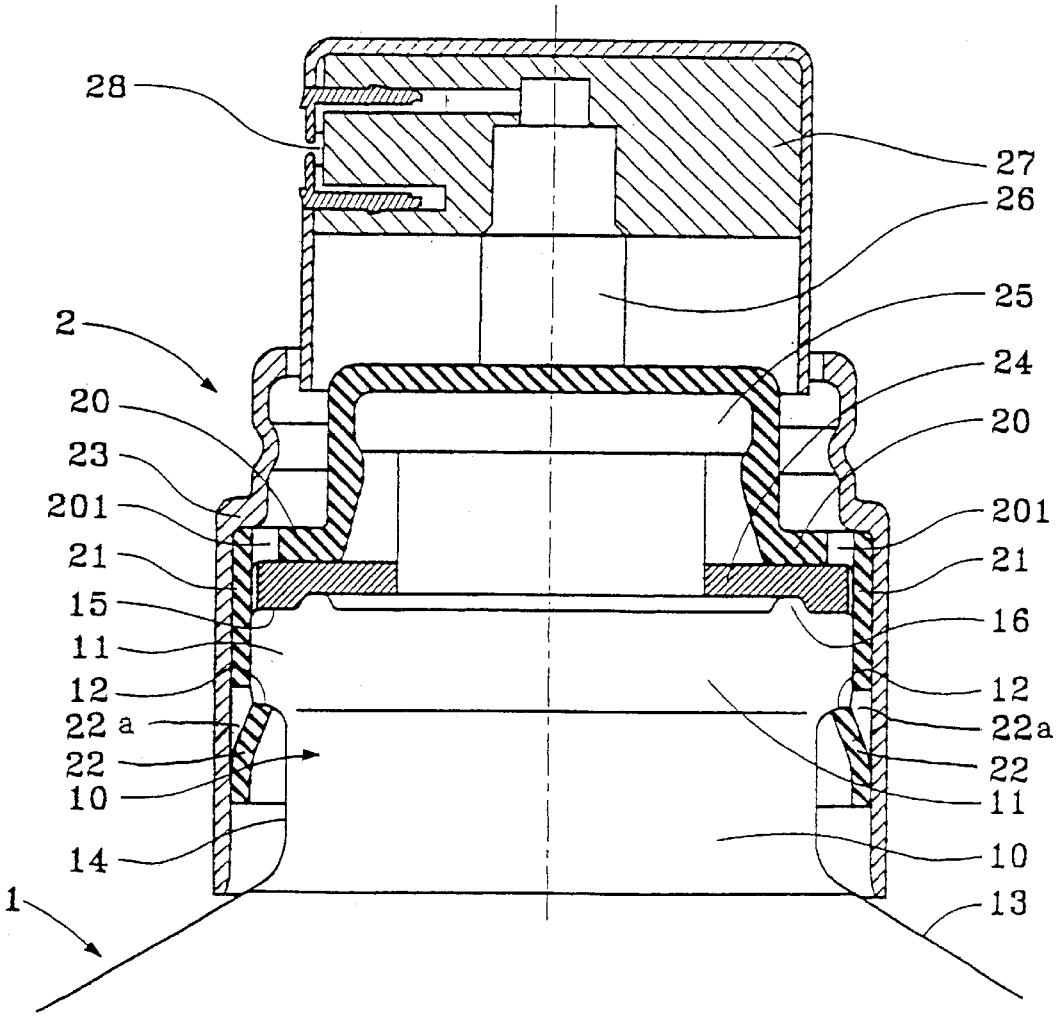
FIG. 1 is a fragmentary, partial cross-sectional view of a container, dispenser member, and fixing device according to the present invention.

The container 1, which may be made of plastic or of glass, is in the form of a body 13 serving to contain a fluid substance and having a neck 10 at its top. It can be seen that the neck 10 extends from the body 13 in the form of a cylindrical section 14, then forms an outwardly-projecting shoulder 12, and terminates with another cylindrical section of larger diameter forming an outwardly-projecting peripheral thick portion 11. The shoulder 12 thus forms the transition between the thick portion 11 and the remainder of the neck 14 that joins onto the body 1. The top portion of the neck defines an annular surface 15 which may advantageously be provided with an annular sealing bead 16 serving to improve sealing with a neck gasket 24 that provides sealing between the neck 10 and the dispenser member 2.

In the example shown, the dispenser 2 is a pump, but it is also quite conceivable for it to be valve. The internal structure of the pump is not described because it is not critical for the invention. The pump comprises a pump body 25 and an actuating rod 26 on which an actuating head 27 equipped with a nozzle 28 is mounted. For the purposes of fixing the pump to the neck, a fixing ring 20 is provided to serve as the fixing device. The fixing ring is provided with a recess in which the body of the pump 25 is snap-fastened by force, and with a peripheral skirt 21 which extends downwards. The inside diameter of the skirt 21 is equal to or slightly larger than the outer diameter of the thick portion 11 of the neck so that the skirt 21 can be engaged over the neck with a minimum amount of clearance so as to guarantee the stability of the pump.

In the invention, the skirt 21 is provided with flaps 22 cut out from the skirt and whose free ends point upwards and inwards in the snap-fastening position so as to come into abutment against the shoulder 12 of the neck. The flaps 22 are connected to the skirt by their bottom ends, and they curve inwards to extend into contact with the shoulder 12. In register with each flap, the skirt defines a window 22*a* in which the respective flap can be received when it is deformed outwards. The thickness of each of the flaps is advantageously equal to or less than the thickness of the wall of the skirt 21, so that the flaps can be received in the windows 22*a* without projecting either inwardly or outwardly. The flaps may thus be fully contained within their respective windows 22*a*. The flaps can either be pre-stressed with this inwardly-pointing angular position, or else they can be initially received in the respective windows 22*a* in the skirt, and only subsequently bent into their final snap-fastening position. Preferably, the flaps are originally formed to point inwards because this avoids having to perform a subsequent operation in which the flaps are bent inwards beneath the shoulder 12 on the neck. The flaps, and therefore the ring itself are preferably made of a plastics material molded in the state shown in the sole figure. In which case, the ring 20 is provided with windows 201 formed vertically above each flap 22. During molding, these windows make it possible to pass mold pins suitable for defining the free ends of flaps as well as the inside wall sectors of the skirt that are situated above the flaps.

In order to make it possible for the advantage of the invention to be well understood, a description follows of a mounting operation in which the ring 20 is mounted on a neck 10. The ring 20, with the snap-fastenable pump in it, is engaged onto the neck 10 of the container. The bottom portion of the skirt overlies the thick portion 11 of the neck. As the thick portion 11 continues to penetrate into the skirt, the flaps 22 are forced into their respective windows 22*a* because of the small amount of clearance that exists between the skirt and the thick portion. The flaps remain forced into their respective windows 22*a* without projecting outwards until they have gone past the thick portion. They can then return to their initial states in which they project inwardly under the shoulder 12. Their free ends then abut against this shoulder 12, thereby achieving ratchet-type snap-fastening because it is then no longer possible to remove the ring. It should be noted that permanent fixing is achieved by the ring on its own. A decorative band 23 may be engaged so as to overlie the ring 20, but it does not contribute to fixing, and it merely performs an appearance-enhancing function. In addition, since the flaps do not project outwards as they pass over the thick portion, it is possible to mount the band over the ring prior to snap-fastening the ring onto the neck. It is thus possible to pre-mount the band on the ring and to mount the resulting assembly onto the neck, thereby simplifying assembly of the dispenser.

What is claimed is:

1. A fixing device for a dispenser for dispensing a fluid substance, the dispenser being suitable for being fitted to a container provided with a neck, and comprising a dispenser member mounted on the neck of the container, said neck forming an outwardly-extending peripheral thick portion co-operating with the remainder of the neck to form a bottom shoulder, said fixing device comprising a fixing ring having means for fixing the dispenser member to the neck, the fixing ring being provided with a peripheral skirt which extends to below said shoulder, said fixing device being characterized in that said skirt is provided with flaps whose free ends point inwards and upwards and come into abutment contact against the shoulder, thereby snap-fastening the fixing ring to the neck of the container.

2. A fixing device according to claim 1, in which the flaps are pre-stressed to point inwards during manufacture of the fixing ring.

3. A fixing device according to claim 1, in which the flaps are stressed to point inwards once the ring is in position on the neck.

4. A fixing device according to claim 1, in which the thickness of the wall of each of the flaps is equal to or less than the thickness of the wall of the skirt so that they do not project from the skirt as the flaps pass over the peripheral thick portion of the neck.

5. A fixing device according to claim 1, in which the flaps are distributed circumferentially around the skirt.

6. A fixing device according to claim 1, in which the fixing ring is made of a plastics material.

7. A fixing device according to claim 6, in which the fixing ring is provided with windows for passing mold pins suitable for forming the free ends of the flaps.

8. A fixing device according to claim 1 in combination with a dispenser member to provide a dispenser.

9. A fixing device according to claim 8, further including a container provided with a neck, said neck forming a peripheral thick portion defining a bottom shoulder.

10. A fixing device for a dispenser for dispensing a fluid substance, the dispenser being suitable for being fitted to a container provided with a neck, and comprising a dispenser member mounted on the neck of the container, the neck forming an outwardly-extending peripheral thick portion cooperating with the remainder of the neck to form a bottom shoulder, the fixing device comprising:

a fixing ring for fixing the dispenser member to the neck, the fixing ring being provided with a peripheral skirt which extends to below the shoulder, the skirt being provided with snap-fastening means for extending beneath the shoulder of the neck; and a band mounted on the fixing ring, and receiving means, defined between the band and the snap-fastening means, for receiving the snap-fastening means when the snap-fastening means is deflected outwardly by the neck without causing outward distortion of the band.

11. A fixing device according to claim 10, in which the snap-fastening means comprises flaps adapted to abut under the shoulder.

12. A fixing device according to claim 10, in which the receiving means comprises windows formed in the ring, and the snap-fastening means comprises plural elements which are received in the windows when outwardly deformed.

13. A mounting method of a fixing device for a dispenser for dispensing a fluid substance, the dispenser being suitable for being fitted to a container provided with a neck, and comprising a dispenser member mounted on the neck of the container, the neck forming an outwardly-extending peripheral thick portion cooperating with the remainder of the neck to form a bottom shoulder, the fixing device comprising a fixing ring for fixing the dispenser member to the neck, the fixing ring being provided with a peripheral skirt which extends to below the shoulder when mounted to the neck, the method comprising the steps:

premounting a band on the ring so as to extend at least down to a position on the peripheral skirt which would be below the shoulder when the ring is subsequently mounted to the neck; and mounting the ring, with the premounted band, on the neck.

14. A method according to claim 13, in which the skirt is provided with snap-fastening means for extending beneath the neck shoulder.

15. A method according to claim 13, in which the snap-fastening means is outwardly deformed during the passage of the snap-fastening means past the thick portion of the neck.

16. A method according to claim 13, in which the snap-fastening means is received in receiving means formed between the band and the snap-fastening means, during the passage of the snap-fastening means past the thick portion of the neck.

17. An assembly for holding a fluid dispensing mechanism, the assembly comprising:

a fixing ring having a top portion defining an outwardly facing, exterior engagement surface, and having a bottom portion which includes at least one inwardly projecting snap-fastening part which is resiliently deflectable from a self-maintained locking configuration to an outwardly displaced installation configuration;

a band mounted on the fixing ring to extend to an elevation below the snap-fastening part; and the band and the fixing ring bottom portion together defining a space sufficient to accommodate temporary deflection of the snap-fastening part outwardly to the installation configuration.

18. The assembly in accordance with claim 17 in which the fixing ring top portion has an upper end defining an upwardly facing abutment surface; and the band has an inwardly extending annular shoulder defining a downwardly facing locating surface for contacting the upwardly facing abutment surface of the fixing ring to locate the band at a predetermined assembled position on the fixing ring.

19. The assembly in accordance with claim 17 in which the fixing ring bottom portion includes an annular wall; and the fixing ring snap-fastening part is a flap projecting inwardly from the fixing ring annular wall.

20. The assembly in accordance with claim 19 in which the space is a window formed in the annular wall so that at least part of said window is in radial registration with the flap.

21. The assembly in accordance with claim 17 in which the band has an upper portion defining a cylindrical interior surface; and the band has a lower portion defining a cylindrical interior surface with a diameter greater than the diameter of the sleeve upper portion cylindrical interior surface.

22. The assembly in accordance with claim 17 in which the assembly further includes a dispensing mechanism.

23. The assembly in accordance with claim 22 in which the fixing ring top portion defines an upwardly open aperture;

the fixing ring bottom portion defines a downwardly open recess that is larger than the aperture and that communicates with the aperture; and the dispensing mechanism is a finger-actuatable pump having at least (a) a pump body extending through the recess in the fixing ring bottom portion, and (b) a dispenser head extending upwardly from the pump body through and beyond the aperture in the fixing ring top portion.

24. The assembly in accordance with claim 23 in which the assembly further includes a gasket around the dispensing mechanism in the recess.

25. The assembly in accordance with claim 17 in which the fixing ring top portion has an upwardly extending annular shoulder and an annular turret extending upwardly from the annular shoulder;

the turret defines an aperture for receiving a portion of the dispensing mechanism; and the fixing ring bottom portion defines a recess which communicates with the aperture and which can receive a portion of the dispensing mechanism.

26. A method for assembling components for holding a fluid dispensing mechanism prior to mounting the assembled components on a container, the method comprising the steps of:

(A) aligning at least first, second, and third components which include a fixing ring, a band, and a dispensing mechanism wherein the dispensing mechanism has a dispenser member body and a dispenser head projecting from said dispenser membrane body;

the fixing ring has a top portion defining an outwardly facing, exterior engagement surface, and a bottom portion which includes an inwardly projecting snap-fastening part and which is resiliently deflectable from a self-maintained locking configuration to an outwardly displaced installation configuration;

the band has an interior surface; and (B) effecting relative movement between the components to dispose part of the dispensing member body in the fixing ring with the dispenser head extending from the body upwardly beyond the fixing ring top portion and to dispose the band on the fixing ring in engagement with the exterior engagement surface of the fixing ring top portion to hold the band at a predetermined assembled position so that the band and the fixing ring bottom portion define at least one space adjacent the fixing ring bottom portion sufficient to accommodate temporary deflection of the snap-fastening part outwardly to the installation configuration when the assembled components are subsequently mounted on a container.

* * * * *